US011330885B2

(12) United States Patent
Walker et al.

(10) Patent No.: US 11,330,885 B2
(45) Date of Patent: May 17, 2022

(54) HAIR DRYING NET AND TURBAN TOWEL

(71) Applicants: Aurora Walker, Sydney (AU); Andrew Peter Walker, Sydney (AU)

(72) Inventors: Aurora Walker, Sydney (AU); Andrew Peter Walker, Sydney (AU)

( * ) Notice: Subject to any disclaimer, the term of this patent is extended or adjusted under 35 U.S.C. 154(b) by 0 days.

(21) Appl. No.: 15/161,587

(22) Filed: May 23, 2016

(65) Prior Publication Data

US 2018/0249804 A1 Sep. 6, 2018
US 2022/0061489 A9 Mar. 3, 2022

(30) Foreign Application Priority Data

Jun. 5, 2015 (AU) ..... 2015203226

(51) Int. Cl.
*A42B 1/041* (2021.01)
*A45D 8/40* (2006.01)
*A45D 20/18* (2006.01)

(52) U.S. Cl.
CPC ..... *A45D 20/18* (2013.01); *A42B 1/041* (2013.01); *A45D 8/40* (2013.01)

(58) Field of Classification Search
CPC .. A45D 20/18; A45D 8/40; A42B 1/06; A42B 1/006; A42B 1/008; A42B 1/041; A42B 1/012; A42B 1/04; A42B 1/049; A42B 1/201; A42B 1/206; A42B 1/22; A42B 1/225; A42B 7/00
USPC ..... 2/174, 202; 132/274; 34/99
See application file for complete search history.

(56) References Cited

U.S. PATENT DOCUMENTS 1,698,533 A * 1/1929 Brown ..... A45D 20/18 2/174
2,074,270 A * 3/1937 Perkins ..... A45D 20/18 34/99
2,474,165 A * 6/1949 Roberts ..... A45D 20/18 34/99
2,568,399 A * 9/1951 Kahn ..... A42B 1/045 2/174
2,632,960 A * 3/1953 Bucknell ..... A45D 20/18 34/99
2,654,161 A * 10/1953 Bowen ..... A45D 20/18 34/99
2,663,090 A * 12/1953 Flaxman ..... A45D 20/18 34/99
2,820,305 A * 1/1958 Brown ..... A45D 20/18 34/99

(Continued)

FOREIGN PATENT DOCUMENTS

AU 2004210508 B2 * 3/2006
FR 2725594 A3 * 4/1996 ..... A41D 23/00

*Primary Examiner* — Amy Vanatta

(57) ABSTRACT

The multi-functional hair drying net and turban towel for upright application may be used on its own or so combination with a hand held hair dryer. Useful for managing dry and wet hair, to absorb water from wet hair after washing, swimming, or anytime the hair is wet, thereby avoiding dripping of water on the face, neck, or clothes. Used over dry hair to keep hair off the face, back and neck when applying make-up and treatments to the face. When required to dry hair by electrical means the device can be connected to a commercially available hair dryer and used as a conduit to direct warm air into the net cavity and dry hair using electrical means. It can be used to keep hair dry and off the face and back in the bath, shower, Jacuzzi spa or steam bath.

18 Claims, 3 Drawing Sheets

(56) References Cited

U.S. PATENT DOCUMENTS

| | | | | | |
|---|---|---|---|---|---|
| 3,043,016 | A * | 7/1962 | Miller | A45D 20/18 | 34/99 |
| D205,829 | S * | 9/1966 | Gettinger | A42B 3/0406 | 132/274 |
| 3,281,955 | A * | 11/1966 | Clark, Jr. | A45D 20/18 | 34/99 |
| 5,708,982 | A * | 1/1998 | Armani | A45D 8/40 | 2/171 |
| 5,887,357 | A * | 3/1999 | McNair | A45D 20/00 | 34/99 |
| 5,950,636 | A * | 9/1999 | Hickey | A45D 2/46 | 132/200 |
| 6,085,695 | A * | 7/2000 | Miller | A01K 27/006 | 119/795 |
| 2010/0108088 | A1* | 5/2010 | Britton | A45D 8/36 | 132/200 |
| 2012/0030858 | A1* | 2/2012 | Duffin | A42B 3/0406 | 2/183 |
| 2017/0027262 | A1* | 2/2017 | Palmer | A42B 1/12 | |
| 2019/0110542 | A1* | 4/2019 | Kolonne | A42B 1/12 | |

* cited by examiner

HAIR DRYING NET AND TURBAN TOWEL

BACKGROUND

1. Field of Invention

This disclosure relates generally to hair drying devices for use at home or at the beauty salon for managing wet or dry hair, such as hair drying towels, nets, turbans, wraps, caps, bonnets and hoods. More particularly, the present disclosure relates to a novel and multi-functional hair managing and hair drying device, that allows for a person's hair to be confined before or after washing and acts as a conduit for directing heat from a commercially available hair dryer onto the wearer's hair to dry hair in an energy efficient manner.

2. Prior Art

Devices for drying the hair such as hair towels, nets, wraps, turbans, caps and the like are well known in the prior art. Often times, individuals exiting a shower or bath experience the inconvenience of not having a towel of the proper shape or size to contain and dry wet hair without significant amounts of water also dripping onto their clothing, as well as onto flooring and carpeting. Conventional hair towels used by many people to dry their hair include bath and general purpose towels which are designed for purposes other than for drying hair. They are bulky and not designed for use on the head. Much time is spent in the wrapping and rewrapping of the conventional turban-like headdress so as to keep the towel wrapped around the hair and head. Primarily, this is due to the fact that the rectangular-shaped bath towel is much larger than needed for drying only the hair and the towel not ideally suited or shaped for wrapping of one's head and hair, nor suitable for holding it above the head, all in all not a satisfactory solution for drying the hair.

It has previously been proposed in the prior art to provide a turban having a forwardly extending portion wherein the wearer is required to lean forward from the waist with their hair falling awkwardly over their forehead and face so as to place their hair in a forwardly extending portion or basket and then move or extend the filled turban backwardly onto the wearer's head so as to fasten the hair basket to a rear portion of said turban.

A hair towel is disclosed in U.S. Pat. No. 2,568,399 of Kahn. This hair towel is more particularly a device comprising a tubular shaped towel. The tubular device has a V-shaped top opening. A plurality of hooks are at opposite sides of the V-shaped opening. Hooks are also located at the corners of the bottom of the tubular device. To wear the device, the head is bent over with the hair hanging downward. The tubular device is drawn over the hair and head, beginning with the top opening. The head is then raised and the device is secured onto the head by fastening the hooks at the V-shaped opening. The bottom corners of the tubular member are raised above the head and brought down behind the head and around both sides of the head. The hooks located at the bottom corners are fastened under the chin. This tubular device has several disadvantages. First, the device has no elastic or gathers for a comfortable and secure fit around the head and hairline. While there are multiple hooks at the top opening to accommodate several head sizes, the fit is not as comfortable or secure as one would be with a device having elastic or gathers. Second, the device is not efficient and delays hair drying because it is not twisted around the hair to remove and absorb excess moisture from the hair. Third, the placement of the hooks under the chin can be annoying and uncomfortable to the wearer.

Other devices such as hair wraps need to be, wound up, and secured on the head by way of fastenings such as a button, loop or other means. These devices are difficult to be worn on the head as unless they are wrapped around the head and secured in place they will not stay on the head; once in place they either fit too loosely or too tightly. A number of hair/head turban assemblies have been employed as illustrated in U.S. Pat. Nos. 1,749,340 of Grean; U.S. Pat No. 2,817,090 of Toellner; U.S. Pat No. 3,111,679 of Reinsberg; and U.S. Pat No. 3,587,114 of McCourtie, but these aforementioned patents involve additional fasteners or elastic thread means for maintaining the head turban in place, wherein the present invention is of simple design as compared to the aforementioned patents. U.S. Pat. No. 5,365,613 of Henegan, describes a hair drying turban made from a single piece of absorbent cloth and having a head portion and, extending forwardly, a hair basket portion. In use, the wearer places the head portion on his or her head with the hair extending forwardly over the forehead and face. Then, with the hair placed neatly within the hair basket portion, the hair basket is twisted about the longitudinal axis of the hair. The hair basket portion is then folded backwardly along the centre line of the head portion and secured to the back of the head portion. A loop is provided to facilitate the tucking in of the hair basket portion beneath the head portion. Unless the hair basket portion of the hair drying turban is secured to the back of the head portion, the turban will fall off the wearer's head.

Hair Dryer Caps, covers, hair drying hoods for use with a hood type hair dryer and bonnets for use with portable compact type hair dryers and blowers are also well know in the prior art. U.S. Pat. No. 2,820,305 of Brown, discloses a hair drying bag for use with a hair drying apparatus, with two openings, one of the opening fits over the head and the other opening attaches to the hair drying apparatus. The disadvantage of this patent is that there are no means to secure the hair drying bag to the hair dryer when the hair dryer is connected to the bag and in operation. Without means of securing the bag to the hair dryer, will result in the hair drying bag becoming detached from the hair dryer when in operation. A Hair Dryer Cap is disclosed in U.S. Pat. No. 3,335,502 of Ritter. These hair drying caps which come in a variety of sizes are however inconvenient to use as they are inflexible, limited in volume, become very hot when in use and typically made of either plastic or waterproof material, both of which are unsatisfactory for managing wet hair. The bonnets are not interchangeable with other similar brands and, have to be purchased together with the portable motor-driven fan unit. In addition to this, the hair dryer bonnet cannot be used for any other purpose, other than, receiving and circulating air within the bonnet and around the head and hair of the user. The bonnet it is not water absorbent, or designed and constructed in such a way, that it can be used as a hair drying towel or the like.

Many of the patents referred to above are pertinent in that they relate to the drying of hair; they either absorb water from wet hair with a towel like member or dry hair by electric means. However, there is no teaching, suggestion or motivation, in the prior art, that discloses a device that addresses these functions within a single device. Furthermore, the combination of the references of the prior art, and the resulting combination of elements would not have been understood to produce a flexible and changeable, hair managing device that has the same benefits and constructed and applied in the manner, of the present disclosure, by someone skilled in the art.

Thus a need has arisen for an improved device for upright application, which is convenient, simple, easy and quick to use, that stays on the head enclosing all of the hair. A device for managing dry and wet hair, keeps wet hair from dripping, absorb excess moisture from the hair. The device is applied to the head and hair to absorb moisture from the hair and without having to remove the device from the wearers head, can be attached to a hair dryer and used to dry or partially dry hair in an energy efficient manner. The device allows the user, to perform other tasks, e.g. applying make-up, donning clothing, other chores, etc. while keeping their hair off their face, shoulders and back.

It is therefore and object of the present disclosure to provide a new hair drying device and method which has some advantages of the hair drying devices mentioned in the prior art and many novel features that result in a new hair drying device which is not anticipated, rendered obvious, suggested, or even implied by any of the prior art hair drying devices.

A preliminary search was conducted on this invention and the following listed patents were uncovered in the search.

References Cited

| Pat. No. | Inventor | Date |
|---|---|---|
| 1,749,340 | Grean | March 1930 |
| 2,632,960 | Bucknell, et al | Mar. 31, 1953 |
| 2,568,399 | Kahn | June 1949 |
| 2,694,204 | Cross | Nov. 16, 1954 |
| 2,820,305 | Brown | Jan. 21, 1958 |
| 2,817,090 | Toellner | Dec. 24, 1957 |
| 3,043,016 | Miller | Jul. 10, 1962 |
| 3,111,679 | Reinsberg | Nov. 26, 1963 |
| 3,335,502 | Ritter | Aug. 15, 1967 |
| 3,587,114 | McCourtie | Jun. 28, 1971 |
| 3,962,728 | Pavlinik | Jun. 15, 1976 |
| 5,029,404 | Terrell | Jul. 9, 1991 |
| 5,365,613 | Henegan | Nov. 22, 1994 |
| 5,490,528 | Day | Feb. 13, 1996 |
| 5,708,982 | Armani | Jan. 20, 1998 |
| 6,029,364 | Pickett | Feb. 29, 2000 |
| 6,560,784 | Hill | May 13, 2003 |
| 7,412,729 | McGovern | Aug. 19, 2008 |
| D388,589 | Walker | Jan. 6, 1998 |
| D412,234 | Cox | Jul. 27, 1999 |
| 7,168,434 | Baldwin | Jan. 30, 2007 |
| AU2004210508 | Walker | September 2004 |

SUMMARY OF INVENTION

The invention, relates to a multi-functional, reversible, absorbent, air-permeable and flexible hair containing and hair managing device for drying hair, which can be used on its own or in combination with a hair dryer to dry hair using electrical means. This multi-functional pull on pull off, one size fits all, hair-containing device for upright application onto the wearer's head, is useful in the management of wet and dry hair. It is extremely easy to use and manipulate, using familiar hand movements to those used by current users of full bath sheets, to wrap hair into a conventional turban.

Therefore, it requires little new training for users. As will become more fully explained hereinafter, the device overcomes the disadvantages of the prior art, is far easier to apply and requires less manual dexterity to ensure a securement on the wearers head.

The device is adapted to fit securely and comfortably on the head of the wearer due to its elasticized top head opening and will not fall off the head, or restrict the activities of the wearer while the hair is drying, even as one moves about quite vigorously. It is lightweight, soft and extremely comfortable to wear.

An important feature of the novel hair drying net and turban towel is that it fulfils the need where the user requires to absorb moisture from wet hair and stop hair dripping, after a wetting, and partly or fully dry their hair, in quick succession, by other means such as using a hair dryer. The hair drying net and turban towel addresses both of these and other functions within the one device.

Another feature of this device is that it is changeable, and easily converts from one hair managing function to another, whether it is worn as a hair towel, hair net, hair protector/hair cover, turban or cap, to address the different requirements of the wearer. The device can also be used similarly on dry hair, and can be worn by people with long and short hair.

As the hair drying net and turban towel is a multi-functional hair managing and hair drying device, it is worn over wet or dry hair, pulled over the head and hair to cover all of the wearers hair. The device is generally worn as a towel, turban or cap from the time a person steps out of the bath or shower after washing their hair, to stop wet hair dripping, up to when the hair is dry or partly dry or ready for styling. There is no need to comb the hair prior to placing the device on the wearer's head when the hair is wet and dripping as this is when the hair is most vulnerable and likely to break. In one of its functions, the device is used as a hair towel to absorbs moisture from a person's wet hair wherein the device is worn as a head and hair covering/hair protector, to sit on the head, hang loosely around the head and down the shoulders and back of the wearer, where the net forms a pocket when the hair basket opening is gathered. The resultant pocket that forms in the fold of the fabric when the hair basket opening is gathered, absorbs moisture from wet hair and stops hair dripping, stops long hair getting tangled and keeps long hair within the pocket and not protruding through the hair basket opening. In this position the hair basket portion of the net, can be secured at the nape of the neck or twisted and arranged into a turban on the head of the wearer, both functions achieved by means of the elastic strap/ribbon or other fastening means located around the perimeter edge of the hair basket opening. The wearer has other options, such as turning the hair drying net and turban towel into a double walled cap by twisting and reversing the hair basket portion inside out to fit over the hair cover already in place on the head and securing to the head by means of the elastic strap or other fastening means located around the hair basket opening. The extension of the V shaped slit and elastic strap assists to arrange the hair basket portion of the thus formed cap around the head of the wearer. The double walled cap is useful to keep the head warm and absorb further moisture from the hair. All of the above actions allows the wearer to keep the hair off their face, back and shoulders when applying creams, make-up and beauty treatments to the face and body.

Another feature of this device, is that it converts to a hair drying net by using the hair basket portion as a conduit to introduce warm air into the net cavity. The net is attached to the hair dryer by the elastic loop formed by dividing the elastic strap surrounding the edge of the hair basket bottom opening to keep the net connect to the dryer when the hair dryer is in operation, to dry or partially dry hair, ready for styling, in an energy efficient way. The device can also be worn over hair wrapped curlers where the hair is dried in the same manner using a hair dryer.

The net is of simple construction, making it flexible in use, where the movement of the net during the hair drying process, using a hair dryer, allows the wearer to move the hair dryer normally over the head and hair as though no net was present.

Also a construction feature of this device in use with a hair dryer, is that it is of sufficient length and width for there to be ample space within the net, so that the inflow of warm air does not blow directly onto the hair of the wearer, unless the wearer specifically requires it.

The drying of hair contained within the net, prevents long hair getting caught in the air inflow motor of the hair dryer as can occur when no net is present.

The absorbent net has a head covering portion and a contiguous hair basket and twirling portion, is: constructed from a rectangular single sheet of moisture absorbent and air permeable cloth; cylindrically configured, where the two short edges are sewn together to form a tube with two open ends; where both ends are elasticised around the perimeter edge, with a centre seam running two thirds of the length of the tube resulting in a V shaped slit at the bottom end of the net.

The top head cover opening, is elasticized for adjusting to heads of varying sizes and encircles the wearer's head.

The hair basket opening offers a unique feature due to its adjustable arrangement and method thereto, This opening is managed by two separate integral features, being the elastic strap fitted with a cord lock and the V shaped slit, both functioning separately and together. The arrangement of this opening is dependent on the required function of the hair drying net and turban towel, wherein the hair basket opening is controlled by an elastic strap threaded through a cord lock fitted around the perimeter edge of the hair basket, thus adjusting the size of the opening. Depending on the required function of the device, the wearer is able to lengthen or shorten the elastic strap, by pulling the strap through the cord lock, thus allowing the wearer to simultaneously adjust the length of the elastic strap, and regulate the size of the opening.

The lengthening or shortening of the elastic strap effectively also divides or extends the hair basket opening. Extending the strap into one continuous strap, by pulling the strap flush with the cord lock, merges the V shaped slit with the hair basket opening, creating one continuous opening which facilitates the arranging of the hair basket portion on the head of the wearer, in a backwardly or forwardly facing turban, and using the extended strap to secure the turban on the head of the wearer. Extending the elastic strap around the hair basket opening, also allows the wearer to arrange the device into a double walled cap with the reversed hair basket portion covering the head portion already in place on the head, and the extended elastic strap securing the cap on to the head of the wearer. The V shaped slit allowing for expansion of the hair basket opening and as adjustment means around the head of the wearer.

Dividing the strap into two parts by pulling the strap through the cord lock, effectively divides the strap, and reduces the size of the hair basket opening. One part of the strap gathers the hair basket opening to custom fit the air outflow nozzle of a hair dryer and the other part forms a loop for attaching the net to the hair dryer for when the hair dryer is connected to the net and in operation. The reduction in the size of the hair basket opening by the division of the elastic strap means that the V shaped slit now functions as an air exhaust vent for expelling circulated air from within the net during the hair drying process. Circulated air from within the net is also expelled via apertures present in the weave of the fabric.

The V shaped slit adjacent to the hair basket opening fulfils many functions. In addition to serving as an exhaust vent for when the net is connected to a hair dryer, and for the purposes of arranging the hair basket to the wearer's head, to form a turban, or other arrangement on the head, the V shaped slit also serves to extend the hair basket opening to its maximum, such as when forming the double walled cap, to form the head band, and for fitting around the edge of an upright hood hair dryer.

This device captures all loose hair dislodged from the head during the hair drying process.

It is presently contemplated for this embodiment to be manufactured of terry cloth or other such absorbent and air-permeable materials. However it can be manufactured in different materials and according to the wearer's requirement of use.

This device can be used by left handed or right handed users.

BRIEF DESCRIPTION OF THE DRAWINGS

The above-mentioned features, objects and advantages of the present disclosure will become more apparent with reference to the following description taken in conjunction with the accompanying drawings wherein like reference numerals denote like elements and in which:

FIG. 3 also shows an expanded view of the elastic strap fitted through the cord lock.

Thirdly the resultant loop serves to hang the net on a door handle or hook for when the net is not in use. The gathering of the hair basket opening edge forms a fold in the net providing a hair basket for retaining long hair within the net and absorbing moisture from wet hair FIG. 22 shows the side view of a head band worn on the head. Starting from the hair basket opening where the elastic strap is released through the cord lock to create a continuous strap and the material gathered there smoothened, and finishing at the head opening to form the head band by rolling the net back on itself for the full length of the net. The head band is placed on the head with the elasticized head opening edge against the head for anchoring the head band on the head. FIG. 23, shows a side view of the net being worn as a head scarf, where the net is worn with the centering seam placed at the back of the head and the V shaped slit facing down. The elastic strap around the hair basket opening is replaced by a wide ribbon threaded through a channel sewn or stitched around the perimeter edge of the hair basket opening. The wearer places the head and hair covering on the head and wraps the hair basket portion around the hair in the same way as the hair drying net and turban. The adjustable V shaped slit allows for the arrangement of the hair basket at the back of the head, but instead of the elastic strap used as securement means, a ribbon is used to secure the head covering on to the head of the wearer also covering the elasticized edge of the head opening. In FIG. 24 the net is capable of being utilized by the wearer as a loose fitting hat where the hair basket opening of the net is gathered around the perimeter edge by pulling the elastic strap through the cord lock which in turn reduces the size of the opening, this is required to form the basis for the hat. The net is then folded over double with both of the elasticised ends sifting together at the top or back of the head, with the hair basket opening on the outside of the hat and the sides of the net falling forwards. The hat can also be worn with the hair basket opening, gathered by the elastic strap, placed on the crown of the head with the sides of the net falling forward over the face. The elastic strap around the hair basket opening can be substituted for a ribbon to gather the edge and a bow can be tied with the ribbon to keep the edge gathered. The edge of the net is then folded back with the gathered head cover opening placed to sit on or above the ears so that the hat is now fitted and not sitting loosely on the head. The hat can then be arranged with edgings tilted up at the front and back or any other way suitable to the wearer and manufactured in various suitable materials and colours. In FIG. 25 the net is capable of being worn as a head and neck wrap FIG. 25, where the elastic strap of the hair basket opening is extended to allow for the net to be pulled over the head and face to sit at the base of the neck. The elasticized opening of the head cover sits on top of the head, and around the face and under the chin of the wearer enclosing all of the wearer's hair, to keep the wearer warm. The elastic band around the head opening can be omitted for a different look where the head cover of the net then drapes over the head and hair. The net may be made of any suitable material such as knits, cotton or polyester fleece materials.

DRAWINGS

Reference Numerals

Figure 1:
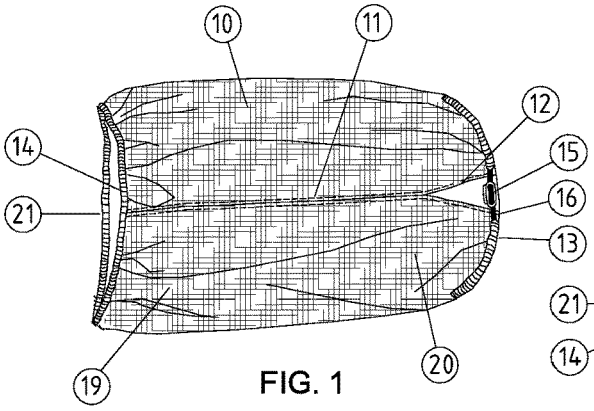
FIG. 1 is a plan view of the present disclosure showing the flattened cylindrical shape of the absorbent hair drying net and turban towel; prior to the net being put to use on the head; with two open ends, with a centering seam running longitudinally two thirds of the length of the tube, separating into a V shaped slit at one of the ends which is fitted with an elastic strap threaded through a cord lock controlling the opening.

10 Hair drying net and turban towel
11 Centering seam

12 V shaped slit
13 Hair basket opening
14 Head opening
15 Cord Lock
16 Elastic strap
17 Hair pocket
19 Head Cover
20 Hair Basket
21 Elasticised Head Opening
22 Hair Dryer for illustrative purposes only and does not form part of this disclosure
23 Elastic loop being part of the elastic strap 16

DETAILED DESCRIPTION OF THE PREFERRED EMBODIMENT

Referring now to FIG. 1 of the drawings, shows the hair drying net and turban towel 10 before being put to use on a person's head, constructed in accordance with the present disclosure comprising a soft hair towel to be used on its own or in conjunction with a hair dryer. The tube is constructed from a rectangular piece of moisture absorbent, air permeable and flexible material, of pre-determined size formed into a tube with two open ends, by sewing or stitching the two short edges of material together into a seam 11 two thirds of the way through, forming a tube with a V shaped slit 12; the edges of both openings 13 and 14 is folded over to form a channel; the head cover opening 14 is gathered by elastic means to adjust to heads of different sizes; the bottom/hair basket portion opening 13 contains the cord lock 15 threaded through an elastic strap 16. In other embodiments, the cord lock 15 fitted through the elastic strap 16 may be replaced by other fastening means or omitted whereby the elastic strap may be manipulated to perform the same function undertaken by the cord lock.

Figure 2:
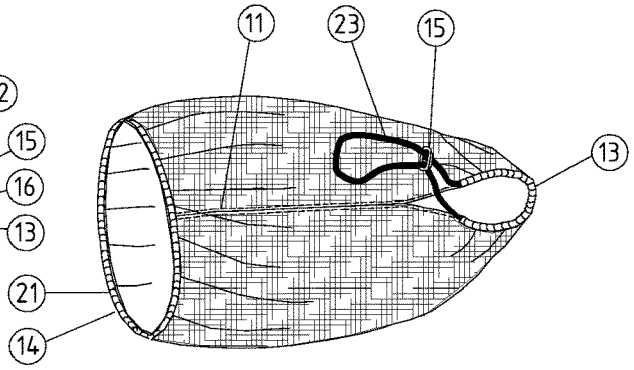
FIG. 2 is a plan view of the present disclosure showing the net with the elastic strap pulled through the cord lock at one end of the net, thus gathering and reducing the size of the opening and dividing the strap into two parts.
Figure 3:
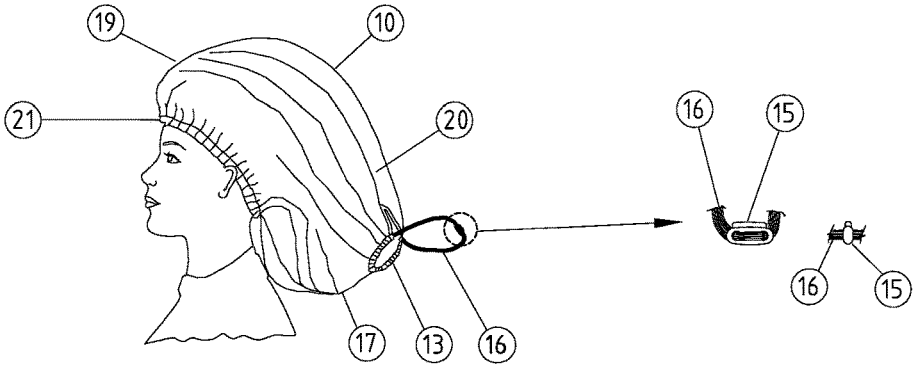
FIG. 3 is a side view of the present disclosure applied to the wearer's head enclosing all of their hair and is the initial position of the hair drying net and turban towel when first placed on the head showing the head portion and the extended hair basket portion of the net with the cord lock sitting flush on the elastic strap.

Referring to FIG. 2 of the drawings of the hair drying net and turban towel, shows the net 10 in preparation for fitting on a head, with the elastic strap 16 pulled through the fitted cord lock 15 thus gathering and adjusting the size of the hair basket opening 13 and dividing the strap. As shown in FIG. 3 of the drawings the hair drying net and turban towel 10 in the initial position on the head of a person, showing the net 10 being worn loosely on the head as a head and hair cover/protector, net or towel with the defined head cover portion 19 and hair basket portion 20 extending down the shoulders and back of the wearer. The drawing shows the fitted cord lock 15 sitting flush on the continuous elastic strap 16 situated around the hair basket opening 13 and the hair basket opening 13 combined with the V shaped slit 12 merging the two openings into one continuous opening. The net 10 can be arranged into a turban or cap with the use of the extended elastic strap 16. The elastic strap 16 can be used to hang the net up for easy access and when not in use.

Figure 4:
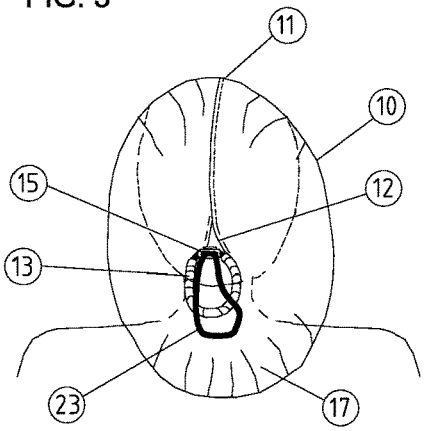
FIG. 4 is a rear view of the present disclosure on a head, showing the gathered edge of the hair basket bottom opening and the position of the cord lock at the mouth of the opening, dividing the opening from the V shaped slit. The hair basket opening is used for introducing warm air into the net cavity by way of a hair dryer. The positioning of the cord lock at the mouth of the V shaped slit serves a few functions. Firstly, the cord lock separates the V shaped slit from the hair basket opening so that the slit would then function as an air vent for ventilation purposes, when the net is connected to a hair dryer and in operation. This enables air circulating within the net to be expelled from the net through this V shaped slit during the hair drying process. Secondly the cord lock divides the continuous elastic strap into two parts: one part gathering the edge of the hair basket opening and thus reducing the size of the opening on one side, to custom fit the air outflow nozzle of a hair dryer, the other part forms a loop used as attachment means of the net to the hair dryer.

FIG. 4 shows a rear view of the net 10 worn on the head, with the centering seam running from the top of the head cover opening 14 nearly the length of the net, terminating in a V shaped slit 12 on the edge of the hair basket opening 13 with the hair basket bottom edge gathered by the elastic strap 16 divided into two parts by the cord lock 15 sitting at the mouth of the V shaped slit. The gathering of the elastic strap 16 along the edge of the hair basket opening 13, by pulling the elastic strap 16 through the cord lock 15, reduces the size of the hair basket opening 13 and at the same time divides the elastic strap 16 into two parts. The reduction in the size of the opening 13 lifts up the edge of the hair basket opening 13 to form a pocket 17 due to the fold in the material at the hair basket end 20 of the net 10, just below the nape of the neck to stop wet hair from dripping and to retain long hair without the hair becoming tangled when the net 10 hangs vertically down the back. In this position a hair dryer can be attached to the net 10 by the elastic loop and the air outflow nozzle of the dryer fitted through the hair basket opening 13 to serve as a conduit to introduce warm air into the net cavity to save on energy costs and speed up the hair drying process.

Figure 5:
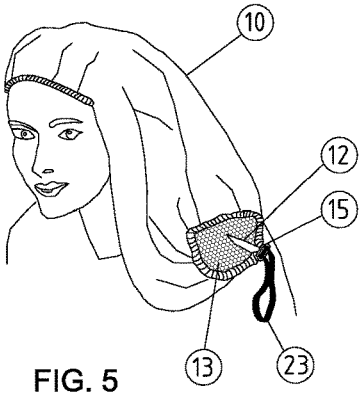
FIG. 5 is a front view of the present disclosure showing the hair drying net and turban towel positioned on the head with the cord lock dividing the elastic strap into two parts
Figure 6:
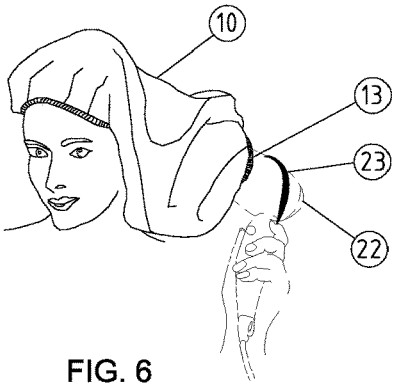
FIG. 6 is a front view of the present disclosure applied to the wearer's head with the hair drying net draped over the head of the wearer and the air outflow nozzle of a hair dryer inserted into the net
Figure 7:
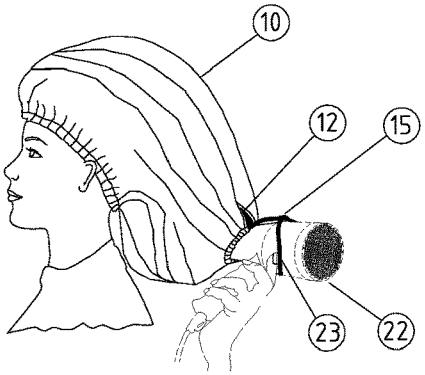
FIG. 7 is a side view of the hair drying net on the head of the wearer with the air outflow nozzle of a hair dryer inserted through the opening and showing the elasticised loop of the extended elastic strap used to attach the hair drying net to the hair dryer, and the V shaped slit formed by the truncated seam around the hair basket opening used as an air exhaust vent

FIG. 5 shows a front view of the net 10 worn on the head showing the elastic strap gathered around the hair basket opening 13 divided by the cord lock 15, with the remainder of the strap 16 forming a loop, with the hair basket opening edge 13 adjusted to receive the air outflow nozzle of a hair dryer 22. FIG. 6 shows a front view of the wearer wearing the net 10 with the air outflow nozzle of a hair dryer 22 inserted into the hair basket opening 13 ready to dry their hair. FIG. 7 shows a side view of the net 10 with the air outflow nozzle inserted into the hair basket opening 13 of the net, with the divided elastic strap 16 gathering the hair basket opening on one side and the resultant loop 23 on the other side of the cord lock, serving to secure the net to the hair dryer 22.

Figure 8:
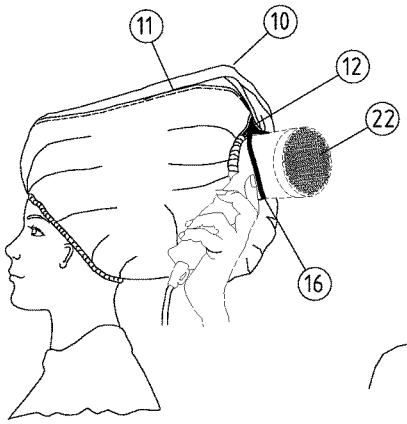
FIG. 8 is a side view of the hair drying net on the head of the wearer with the net attached to a hair dryer and in operation, where the net balloons due to the concentration of air introduced within the net cavity

Referring now to FIG. 8 which shows the inflated net 10 being worn on the head with the centering seam 11 at the top of the head and the V shaped slit 12 at the bottom of the net facing up, connected to a hair dryer 22. The injection of air from the hair dryer 22 into the net cavity 10 through the hair basket opening 13 of the net 10 causes the net 10 to balloon and for the hair to move freely within the net, due to the flexible construction of the hair drying net and turban towel 10. The V shaped slit 12 situated at the hair basket end of the net 10 facing upwards, serves in this instance as an exhaust vent to expel circulated air from within the net. Circulated air from within the net 10 is also expelled through the openings in the weave of the fabric.

Figure 9:
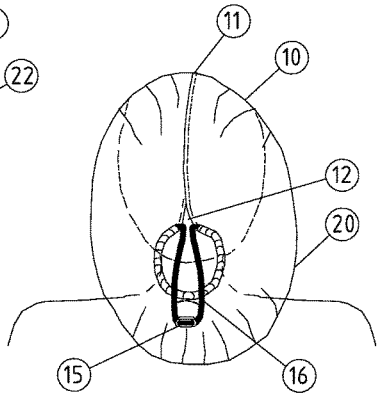
FIG. 9 is a rear view of the hair drying net on a head showing the gathered bottom edge opening of the hair basket, the continuous elastic strap and the position of the cord lock flush with the elastic strap
Figure 10:
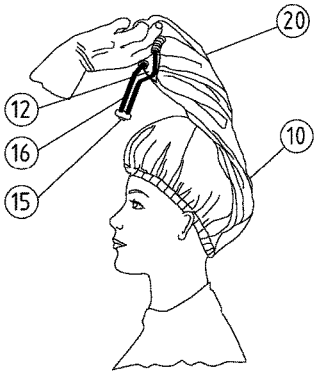
FIG. 10 is a side view of the net on the wearer's head showing upward vertical pulling by the wearer of the twirled hair basket portion, for purposes of ultimately arranging the hair basket into a forward facing turban using the extended elastic strap to secure the turban on the head of the wearer
Figure 11:
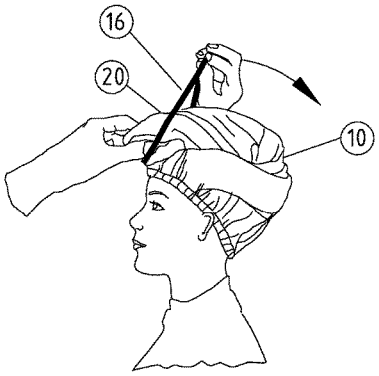
FIG. 11 is a side view of the net on the head of a wearer being arranged into a forward facing turban with the hair basket placed on top of the head, at the forehead, and the continuous elastic strap being pulled backwards to rest at the back of the head or nape of the neck, so as to secure the hair drying turban to the head of the wearer
Figure 12:
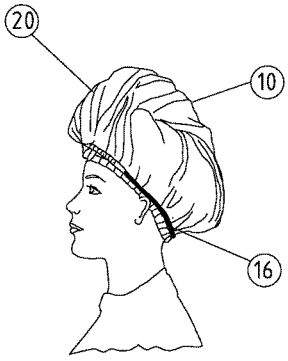
FIG. 12 is a side view of the net arranged into a forward facing turban on the head
Figure 13:
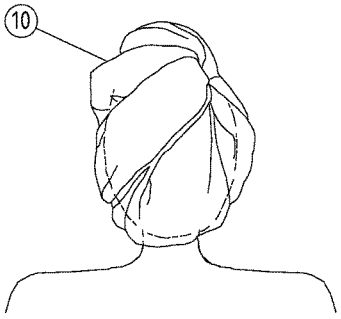
FIG. 13 is a rear view of the net on the head arranged into a forward facing turban
Figure 14:
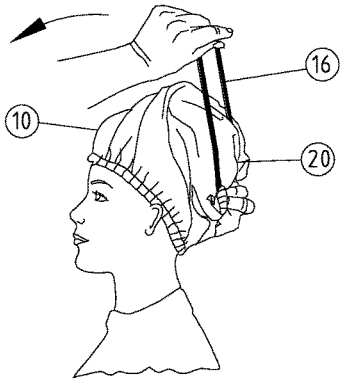
FIG. 14 is a side view of the net on the wearer's head being arranged into a backward facing turban with the hair basket placed at the back of the head/nape of the neck and the continuous elastic strap being pulled forwards to rest on top of the head/forehead so as to secure the hair drying turban to the head of the wearer
Figure 15:
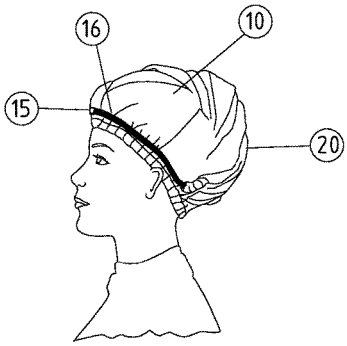
FIG. 15 is a side view of the net arranged into a backwards facing turban on the head
Figure 16:
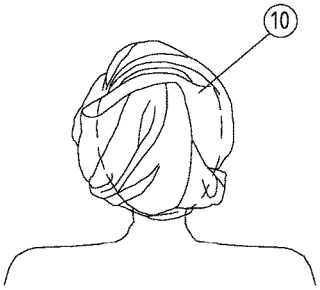
FIG. 16 is a rear view of the net on the head arranged into a backward facing turban
Figure 17:
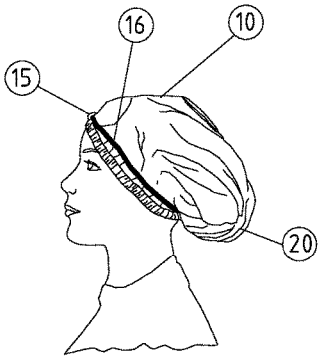
FIG. 17 is a side view of the net arranged as a head covering/single walled cap on the head of the wearer secured to the head by the elastic strap
Figure 18:
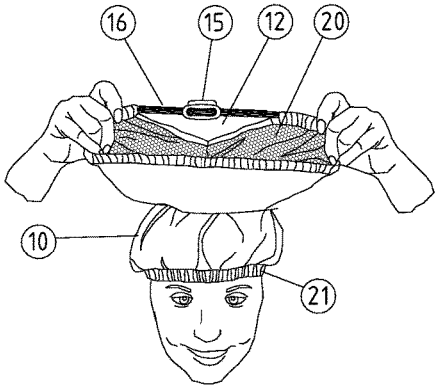
FIG. 18 is a front view of the net being arranged into a double walled cap showing the hair basket portion of the net is reversed to sit over the head portion of the net already in place on the head and showing the extended elastic strap of the hair basket opening
Figure 19:
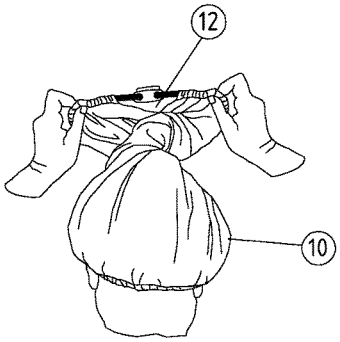
FIG. 19 is a rear view of the net showing the hair basket portion twirled at the crown of the head with the hair basket portion about to be reversed and placed over the head cover portion on the head of the wearer
Figure 20:
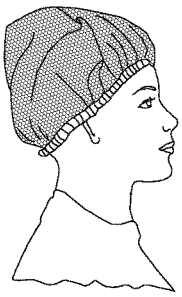
FIG. 20 is a side view of the net arranged into a double walled cap on the head
Figure 21:
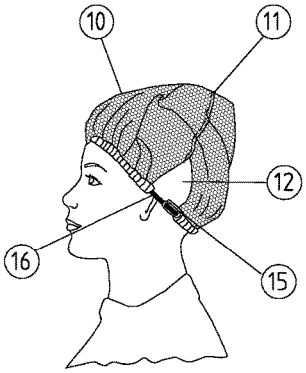
FIG. 21 is a side view of the net arranged into a double walled cap on the head showing the reversed hair basket portion covering the head and the extended V shaped slit accommodating the arrangement of the double walled cap

FIG. 9 is similar to FIG. 4 where the only difference between the two drawings is the position of the cord lock 15 on the elastic strap 16 around the hair basket opening 13. In this instance the cord lock 15 is sitting flush with the continuous elastic strap 16 and the V shaped slit 12 is combined with the hair basket opening 13. In this position the net 10 is capable of being arranged on the head of the wearer into a turban and a single or double walled cap. FIG. 10 shows how a forwardly facing turban FIG. 12 or backwardly facing turban FIG. 15 is formed by twisting the hair basket portion 20 of the net 10. The Turban arrangement of FIG. 12 and FIG. 15 is achieved by twisting the hair basket longitudinally about its central axis and around the wearers hair once, and then pulled forwards FIG. 11 towards the wearer's forehead or backwards FIG. 14 towards the back of the neck, to form a forwardly facing FIG. 12 and FIG. 13 or backwardly facing FIG. 15 and FIG. 16 turban. The merging of the hair basket opening 13 combined with the V shaped slit 12 allows for the sides of the V shaped slit 12 to extend on either side of the head allowing the bottom edge of the hair basket 13 to sit flat against the head, with the edge resting either on top of the head or at the nape of the neck with the hair basket 20 conforming to the head of the wearer in a wrapped arrangement and secured on the head by means of the elastic strap 16 sitting on the opposite side to the placing of the hair basket 20. FIG. 17 shows a side view of a hair cap arrangement on a head as another option to a hair cover and hair protector where the hair basket 20 is folded under at the nape of the neck and not twisted into place. In this arrangement the centering seam 11 of the net 10 is placed at the nape of the neck and the V shaped slit 12 is facing downwards so that the V shaped slit 12 so that the slit conforms to the back of the wearer's head so as to arrange the hair basket 20 at the nape of the neck with the elastic strap 16 pulled over the head to sit on top of the head/forehead to keep the cap in place. FIG. 18 to 21 shows the front, back and side view of a double walled cap formed by twisting the hair basket 20 once about the crown of the head. Then turning the hair basket portion 20 inside out with the elastic strap 16 and V shaped slit 12 extended to its maximum, to allow for the placing of the reversed hair basket portion 20 over the head portion 19, covering the edge of the head portion 19 of the net 10 to form a double walled cap to further extract moisture from wet hair and keep the head warm.

The net 10 can be made of any suitable material such as terry cloth, towelling, waffle, cotton, cotton velour and other such materials.

Operation

In operation, one uses the device in a similar manner as the hair drying turban towels in present use. The wearer places the net 10 on his or her head, placing the seam 11 on top of their head, or nape of the neck depending on the required use, with the sides of the net 10 hanging loosely around the head and shoulders of the wearer. The extended hair basket portion 20 of the net 10 sitting at the top of the shoulders and back of the wearer with the V shaped slit 12 of the hair basket 20 facing upwards or downwards 12, enclosing all of their wet or dry hair within the net 10, securely fitting about the head and hair due to the elasticised edge. The reason for the V shaped slit 12 to be facing upwards is so that once the net 10 is attached to a hair dryer 22 the V shaped slit 12 sits adjacent to the air outflow nozzle of the hair dryer 22 and therefore warm circulated air expelled from within the net 10 cavity does not discharge directly onto the user's hand. The reason for the V shaped slit 12 to be facing downwards is so that the net 10 can be arranged into a single walled cap.

Then, with the hair placed within the net 10, and hair basket portion 20, the net 10 is either worn loosely on the head as a head and hair covering/hair protector, or the extended hair basket portion 20 is tucked under at the back of the head with the V shaped slit extending around the sides of the head and sitting flat against the neck of the wearer to form a single walled cap FIG 17 with the extended elastic strap 16 used as securing means of the hair basket 20 to the head of the wearer. A further option is for the hair basket portion 20 of the net 10 to be turned inside out and placed over the head cover 19 to form a double walled cap FIGS. 18 and 19, or the hair basket portion 20, twisted once about the longitudinal axis of the hair and arranged on the head in either a backwardly or forwardly facing turban FIGS. 10-16. This is achieved by twirling and folding the hair basket 20 backwardly or forwardly, over the center of the wearer's head and placing the V shaped slit 12 and edge of the hair basket opening 13, flat against the head, with the sides of the V shaped slit fully extended on either side of the head. Securing of the hair basket portion 20 to the head is achieved by pulling at the extended elastic strap 16, situated around the edge of the hair basket opening 13, in the opposite direction to the placing of the hair basket 20, to either rest at the front or back of the wearer's head.

When the wearer is ready to dry their hair using electrical means, the turban/hair basket 20 is unwrapped and the size of the hair basket opening 13 is resized to custom fit the air outflow nozzle of a hair dryer 22. This is accomplished by pulling the elastic strap 16 through the fitted cord lock 15 thereby dividing the strap into two parts which in turn reduces the size of the opening 13.

The outflow nozzle of the hair dryer 22 is inserted into the now reduced opening 13 of the hair basket 20 and the hair basket portion is then used as a conduit to introduce warm air into the net 10 cavity. The resultant elastic loop 23 formed by dividing the strap 16, by pulling the strap through the cord lock 15, is used to attach and secure the net 10 to the back of the air inflow nozzle of a hair dryer 22, to keep the net 10 connected to the dryer 22 during the hair drying process. When the hair dryer is activated, the heated air introduced into the net 10 cavity is directed inwardly in a uniform manner, causing the net 10 to balloon during the hair drying process, consequently allowing for the hair to move freely and naturally within the net 10, and providing drying of the hair on the head placed therein. During this process the wearer is able to touch their hair and scalp, with their free hand placed over the net, move their hair and net 10 around to maximize hair drying, and at the same time moving the hair dryer 22 over their head and hair despite the net 10 being present and connected to the hair dryer, due to its flexible construction.

Once the hair drying operation has been completed the air outflow nozzle of the hair dryer 22 is removed from the hair basket opening 13 and the net 10 separated from the hair dryer 22 by detaching the elastic loop used to secure the net to the dryer. The net 10 is either removed from the head so that the hair can be combed through and styled or the hair basket portion 20 of the net 10 is either tucked in at the back of the head under the elasticized head opening or, the hair basket placed at the back of the head and secured to the head using the elastic strap 16, or the net 10 is left to hang loosely over the head and hair to contain warm air within the net and keep the head warm while the hair is drying.

After use, all loose hair dislodged from the head during the hair drying operation, is removed from the net 10 by turning the net 10 inside out, and shaking it over a basin or dustbin for disposal.

A method of using the hair net on its own over dry hair to keen hair off the face and shoulders or over wet hair to absorb moisture from the hair and worn as a head and hair cover, hair net, hair turban, single and double walled cap, comprising the steps of:

Placing the head cover of the tubular net over the head and hair of the wearer, positioned with the hair hanging down the back of the head and wrapping ail of the hair within the net, with the hair retained within the hair basket portion and for the net to hang loosely about the head anti shoulders;

the hair basket portion is capable of being twisted longitudinally around the hair to maximize the surface contact of said net member with the hair of the wearer enclosed within, then folding hand placing the hair basket portion of said tubular hair drying net against the top or back of the wearer's head in a wrapped or un-wrapped configuration; and merging the V shaped slit with the hair basket bottom edge by releasing the elastic strap through the cord lock unlit the cord lock sits flush on the elastic strap, thus creating a larger flexible opening: and extending the V shaped slit on either side of the head allowing for the edge of the hair basket opening to sit flush on the head; and pulling the said elastic strap surrounding the hair basket bottom opening in the opposite direction to the placing of the hair basket portion in order to secure the hair basket to the head of the wearer: and engaging said elastic strap member surrounding the hair basket opening to secure said net on the head of the wearer in the required configuration whereby the wearer has a choice of arranging the hair basket on the head to form a turban, a single or double walled cap and various other arrangements.

A method of using the hair drying net in combination with a hair dryer for drying hair on the head of a wearer, for use over wet hair of hair wrapped curlers, comprising the steps of:

placing the head cover of the tubular net over the head of the wearer, with the centering seam on the top of the head and running from the ton of the head down to the shoulders terminating in the V shaped slit facing upwards: and the net positioned with the hair hangings down the back of the head and wrapping all of the hair within the net or with the hair wrapped in curlers with all the hair retained within the net and hair basket portion, with the net hanging loosely about the head and shoulders; and gathering said hair basket bottom edge of said net member respectively, by drawing together said opening along said elastic strap member extending therethrough by pulling the said elastic strap through the said cord lock, simultaneously dividing the elastic strap fitted around the hair basket opening into two parts, and with one part of the strap gathering the edge of the hair basket bottom opening, thereby varying the size of the opening to custom fit the air outflow nozzle of a hair dryer: and the other part of the strap forming a loop, whereby said loop is used as attachment means for attaching and securing the said net to a hair dryer to keep the net in position and attached to the hair dryer while the dryer is in operation; and detaching the said loop and separating the net from the hair dryer after drying of hair is completed; and removing the air outflow nozzle of the hair dryer from the said net member; and removing the hair drying net from the wearer's head; and removing all Loose hair caught within the net during the hair drying process whereby the net is shaken to dislodge hair caught within the net The said step of drying hair using a hair dryer further comprises:

inserting the outflow nozzle of a hair dryer into the reduced and customized hair basket opening whereby the hair basket opening becomes a conduit for directing air into the net cavity from a hair dryer.

Additional Embodiments

In one embodiment of the present disclosure, the net is capable of being utilized by the wearer as a protective application to shield the wearer's hair from moisture during showering, bathing, and when in the sauna or steam room, due to its absorbency and method of construction.

In another embodiment of the present disclosure, the net is made entirely from a dual layer of moisture absorbent fabric so as to maximize extraction of moisture from the wearer's hair if worn over wet hair or can be used for maintaining warmth of the head and hair.

In yet another embodiment disclosed herein, the net is capable of being utilized by the wearer for purposes of concealing hair loss caused by forms of medical treatment or medication, as well as for the elderly as the net is not heavy to wear and soft on the skin. The net can be manufactured in various fabrics, and weights more suitable for the purpose it is to be used for.

In a further embodiment, the net is capable of being used as a diffuser for use with an upright hooded hair dryer to dry hair, and to capture and contain all air generated by the hood hair dryer within the net and circulating around the head and hair of the wearer. The net is fitted over the mouth of the hood hair dryer at one end and over the head and hair at the other end. The elastic strap around the edge of the hair basket opening of the net is released by pulling the cord lock flush with the elastic strap, thereby releasing the fabric gathered there and creating a continuous strap. Once the fabric has been smoothened at this end, the user can then place the hair basket opening over the mouth of the upright hood hair dryer. The V shaped slit around the hair basket opening in the net plays an integral role in adjusting the net to the opening of the hood hair dryer as well as in expelling air from within the diffuser without the need for further ventilation. In yet another embodiment of the hair drying net and turban towel, the elastic strap situated around the hair basket opening may be fitted with a button sewn on a part of the strap that is threaded through the cord lock and that sits on the cord lock, in between the two openings of where the elastic strap is threaded through. This would make it easier for users that have limited use in their fingers or who have arthritis to be able to grab the elastic strap and pull the strap through the cord lock to adjust the hair basket opening.

Figure 22:
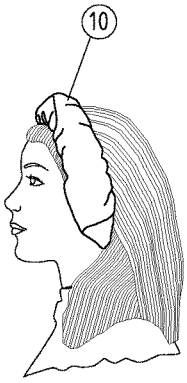
FIG. 22 to 25 are additional embodiments of the hair drying net and turban towel and show a head band, a head scarf, a loose fitting hat and a head and neck wrap.

Additional embodiments are shown in FIGS. 22, 23, 24, 25. In FIG. 22, the net is capable of being worn as a head band, where the elastic strap of the hair basket opening of the net is released by pulling the cord lock flush with the elastic strap, thereby releasing the fabric gathered there. Once the fabric has been smoothened at this end, the wearer can then fold the fabric back on itself until a uniform band forms around the head, covering the ears. The hair band can be manufactured in various fabrics and colours.

Figure 23:
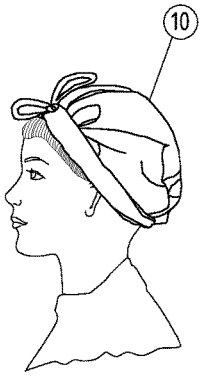

In FIG 23, the net is capable of being utilized by the wearer as a head scarf, where the net is worn with the centering seam placed at the nape of the neck and the V shaped slit facing down. The elastic strap around the hair basket opening is replaced by a wide ribbon threaded through a channel sewn around the hair basket opening or the ribbon stitched to the perimeter edge of the hair basket opening. The wearer places the head and hair covering on the head and wraps the hair basket portion around the hair in the same way as the hair drying net and turban, but instead of the elastic strap, the ribbon is used to secure the head covering on to the head of the wearer covering the elasticized edge of the head opening, with the adjustable V shaped opening allowing for the arrangement of the hair basket at the back of the head.

Figure 24:
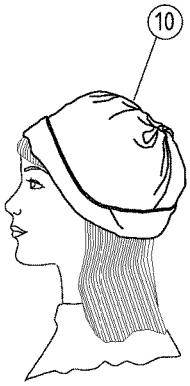

In FIG. 24 the hair drying net and turban towel is capable of being utilized by the wearer as a loose fitting hat, where the hair basket opening of the net is gathered around the perimeter edge by pulling the elastic strap through the cord lock which in turn reduces the size of the opening. The net is then folded over double with both of the elasticised ends sitting together at the top or back of the head thereby forming a hat and worn on the head, with the sides of the net falling forwards. The hat can then be arranged with edgings tilted up to form a brim at the front and back or any other way suitable to the wearer and manufactured in various materials. As a variation to this embodiment, the net is placed over the face and head with the gathered edge of the hair basket opening at the crown of the head. The net is then folded back on itself with the elasticized head cover opening sitting around the head and ears. The fold resulting from the shortening of the net is turned over around the head forming a brim for the fitted hat as opposed to a loose fitting hat.

Figure 25:
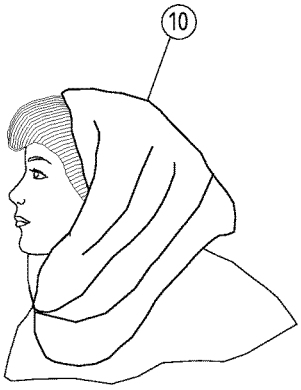

In FIG. 25, the hair drying net and turban towel is capable of being utilized by the wearer as a head and neck wrap, where the elastic strap of the hair basket opening is extended to allow for the net to be pulled over the head and face to sit at the base of the neck. The elasticized head cover opening sits on top of the head, around the face and under the chin, enclosing all of the wearer's hair, to keep the wearer warm. The elastic strap gathering the head cover opening may be omitted to create a different look, whereby the opening then drapes over the wearer's head and hair. The net may be made of any suitable material such as knits, cotton or polyester fleece materials.

Advantages

Among the many advantages of the hair drying net and turban towel of my disclosure are the following:

a) The hair net helps to reduce hair drying time and hair breakages during the hair managing process where the hair drying net and turban towel absorbs moisture from wet hair without having to rub the hair, as well as dries hair by electrical means when a hand held hair dryer is attached to the net, to dry or partly dry hair, when hair is then easier to comb through with less breakages b) When worn as a hair protector, turban or hair cap the net keeps the hair off the face and back of the wearer, when having salon treatments, where the device protects the hair from inadvertent application or spillage of oils and other such products to the hair c) The net is extremely useful when worn as a hair protector over hair that has been treated with oils, deep conditioning treatments and the like where it will keep the head warm and the warm air generated within the net will enhance the hair treatment. Warm air from a hair dryer can also be introduced into the net cavity through the hair basket opening of the net during treatment, further assisting with the development, absorption and enhancement of the hair treatment d) When worn loosely over wet or dry hair, the hair drying net does not flatten the hair, particularly at the forehead due to its loose fit and gathered edge around the head opening e) The net can be worn as a hair and face protector for use over the hair and face when trying on clothes so as to protect the user's hair style and make-up and not soil clothes with make-up f) Protects the wearers neck, forehead, face, eyes, ears, temples and skin areas from overexposure to heat when this device is used in conjunction with a hair dryer g) The net stops long hair and loose hair from being drawn into the hair dryer air intake opening when in operation as the net contains all of the wearer's hair h) Wearing the hair net during the hair management process retains all loose hair dislodged from the head within the net for disposal later i) The net can be personalized by adding logos and manufactures in different colours and materials j) Economical and easy to manufacture, simple and efficient to use, soft, lightweight, machine washable, dry, store and re-useable As described herein-above the objects and advantages of this disclosure should be readily apparent. The device can be used to absorb water from the hair after washing, swimming, or anytime the hair is wet, thereby avoiding dripping of water on the face, neck, or clothes. When required to dry hair by electrical means the device can be connected to a commercially available hair dryer and used as a conduit to direct warm air into the device and dry hair using electrical means. It can be used to keep hair dry and off the face and back in the bath, shower, Jacuzzi, spa or steam bath.

Conclusions, Ramifications, and Scope

Accordingly, the reader will see that the multi-functional hair drying net and turban towel of the various embodiments can be used to manage both dry and wet hair effectively. The hair drying net and turban towel may be worn from the time the wearer steps out of the bath or shower after washing their hair, right through to when the wearer has dried or partly dried their hair with or without the use of a hair dryer. The many functions that the hair drying net and turban towel fulfils, go beyond just drying hair. It is easy to use with no complicated closures. It is constructed to pull-on and pull-off the head, one size fits all due to its elasticized head cover opening. The net is easy to wash and re-use and depending on the use of the hair drying net and turban towel, the net may be manufactured in various materials more suitable to the use of the net.

While the device and method have been described, disclosed, illustrated and shown in terms of what are presently considered to be the most practical and preferred embodiment, it is to be understood that the disclosure need not be limited to the disclosed embodiments. It is intended to cover various modifications and similar arrangements included within the spirit and scope of the claims, the scope of which should be accorded the broadest interpretation so as to encompass all such modifications and similar structures. The present disclosure includes any and all embodiments where changes in form and details may be made by one skilled in the art without departing from the scope of the present disclosure. It is also to be understood that the phraseology and terminology employed herein are for the purpose of description and should not be regarded as limiting.

What is claimed is:

1. An apparatus comprising:

a net, formed from a single piece of piece of material, comprising a first end and a second end that are sewn approximately two thirds along their length to form a tube, and the tube defines a V-shaped slit;

the net defines a head cover top portion, comprising an elasticised head opening, and a hair basket portion, comprising a hair basket opening; wherein the V-shaped slit extends to the hair basket opening, the elasticised head opening is elastic and configured to attach the net to a head of a user;

an elastic strap coupled to the hair basket opening and configured to reduce the size of the hair basket opening when a user pulls the elastic strap in relation to the hair basket opening; wherein the elastic strap is long enough to wrap around the elasticised head opening when located on a head of a user; and a cord lock having the elastic strap extending therethrough; wherein the cord lock is configured to allow the user to selectively adjust the size of the hair basket opening and secure the hair basket opening, about the elasticised head opening, to a head of a user.

2. The apparatus of claim 1, wherein the material is selected from the group consisting of terry cloth, towelling, waffle, cotton, and cotton velour.

3. The apparatus of claim 1, wherein at least a portion of the elastic strap is located within the hair basket opening.

4. The apparatus of claim 1, wherein V-shaped slit acts as a vent when a hair dryer is inserted through, and secured by, the hair basket opening and blows air into the net.

5. The apparatus of claim 1, wherein the elasticised head opening is configured to provide enough force against a head of a user to support the weight of the net.

6. The apparatus of claim 1, wherein the net is reversable, and can be used in both orientations.

7. The apparatus of claim 1, wherein the material is absorbent.

8. The apparatus of claim 1, wherein the material is water resistant.

9. The apparatus of claim 1, further comprising a hair dryer, wherein the hair dryer extends though the hair basket opening and is secured to the net by the elastic strap.

10. An apparatus comprising:

a turban towel comprising:

a net formed from a single piece of material, comprising a first end and a second end that are sewn approximately two thirds along their length to form a tube, wherein the tube has an inside surface, and the tube defines a V-shaped slit;

the net defines a head cover top portion, comprising an elasticised head opening, and a hair basket portion, comprising a hair basket opening; wherein the V-shaped slit extends to the hair basket opening, and the elasticised head opening is elastic and configured to attach the net to a head of a user;

an elastic strap coupled to the hair basket opening and configured to reduce the size of the hair basket opening when a user pulls the elastic strap in relation to the hair basket opening; wherein the elastic strap is long enough to wrap around the elasticised head opening when located on a head of a user; and a cord lock having the elastic strap extending therethrough; wherein the cord lock is configured to allow the user to selectively adjust the size of the hair basket opening and secure the hair basket opening, about the elasticised head opening, to a head of a user;

wherein the turban towel is configured to move between a first position, a second position, and a third position when attached to the head of a user;

in the first position, the elasticised head opening extends around the head of the user, and the elastic strap is a distance away from the elasticised head opening;

in the second position, the elasticised head opening extends around the head of the user, most of the elastic strap is adjacent to the elasticised head opening, and predominantly the outside of the tube is shown; and in the third position, the elasticised head opening extends around the head of the user, most of the hair basket opening is adjacent to the elasticised head opening, and predominantly the inside of the tube is shown.

11. The apparatus of claim 10, wherein the material is selected from the group consisting of terry cloth, towelling, waffle, cotton, and cotton velour.

12. The apparatus of claim 10, wherein at least a portion of the elastic strap is located within the hair basket opening.

13. The apparatus of claim 10, wherein V-shaped slit acts as a vent when a hair dryer is inserted through, and encircled by, the hair basket opening and blows air into the turban towel.

14. The apparatus of claim 10, wherein the elasticised head opening is configured to provide enough force against a head of a user to support the weight of the turban towel.

15. The apparatus of claim 10, wherein the net is reversable, and can be used in both orientations.

16. The apparatus of claim 10, wherein the material is absorbent.

17. The apparatus of claim 10, wherein the material is water resistant.

18. The apparatus of claim 10, in the second position and in the third position edges of the V-shaped slit abut the elasticised head opening.

* * * * *